US005184964A

United States Patent [19]

Douty et al.

[11] Patent Number: 5,184,964

[45] Date of Patent: Feb. 9, 1993

[54] PANEL LOCK FOR A FLOAT MOUNT CONNECTOR

[75] Inventors: George H. Douty, Mifflintown; John M. Landis, Camp Hill, both of Pa.

[73] Assignee: AMP Incorporated, Harrisburg, Pa.

[21] Appl. No.: 843,789

[22] Filed: Feb. 28, 1992

[51] Int. Cl.[5] ..... H01R 13/629

[52] U.S. Cl. ..... 439/247; 439/248; 439/545

[58] Field of Search ..... 439/247, 248, 545; 248/27.3

[56] References Cited

U.S. PATENT DOCUMENTS

| | | | |
|---|---|---|---|
| 3,569,909 | 3/1971 | Garver | 339/91 |
| 4,077,693 | 3/1978 | Briel et al. | 248/27.3 X |
| 4,389,021 | 6/1983 | Coldren | 339/126 R |
| 4,664,456 | 5/1987 | Blair et al. | 339/14 P |
| 4,761,144 | 8/1988 | Hunt, III et al. | 439/545 |
| 4,812,133 | 3/1989 | Fleak et al. | 439/248 |
| 4,824,387 | 4/1989 | deJong et al. | 439/248 |
| 4,845,589 | 7/1989 | Weidler et al. | 361/342 |
| 5,080,604 | 1/1992 | Rider | 439/357 |

*Primary Examiner*—Eugene F. Desmond

*Attorney, Agent, or Firm*—David L. Smith; Gerald K. Kita

[57] ABSTRACT

An electrical connector housing (100) is mounted to float in a back panel (P2) of a drawer. The panel has a T-shaped cut out (178). The housing (100) has upper flanges (144) lower flanges (146) and a top flange (150). In order to mount the connector hosing (100) to the panel, the upper flanges (144) are inserted through the transverse part (182) of the cut out (178) and the housing (100) is then moved along the perpendicular part (180) of the cut out, so that the upper flanges (144) engage the front face of the panel (P2) and the lower flanges (146) engage the rear face of the panel (P2), to retain the connector in the cut out (178). The top flange (150) has one or more sockets (152) and in the, or each, socket (152) a panel lock member (162) having a pnael lock (176). The, or each, panel back member (162) is latched in a retracted position in the socket (152). The, or each, panel lock member (162) can be advanced by pressing it forwardly whereby the panel lock (176) projects forwardly of the top flange (150) thereby preventing the housing (100) returning to such an extent that the upper flanges (144) are aligned to such an extent that the upper flanges (144) are aligned with the transverse part (182) of the cut out so that the housing (100) can fall from the panel (P2).

18 Claims, 16 Drawing Sheets

PANEL LOCK FOR A FLOAT MOUNT CONNECTOR

BACKGROUND OF THE INVENTION

This invention relates to the float mounting of an electrical connector housing in a cut out in a mounting panel, and in particular to a panel lock for arresting movement of the connector in the direction of an edge of the cut out to such an extent that the connector can fall from the panel cut out.

There is disclosed in U.S. Pat. No. 4,664,456 an electrical connector which is float mounted in a cut out in a mounting panel by means of fasteners which extend through oversized holes in the panel, therebeing disclosed in U.S. Pat. No. 4,812,133, an electrical connector which is float mounted in a cut out in a mounting panel by means of a retaining clip which is snapped over the connector to secure it to the panel yet accommodates floating movement of the connector. U.S. Pat. No. 4,761,144 discloses a connector which is float mounted in a cut out in a mounting panel, by means of first and second transverse slots in opposed first and second sides of the housing of the connector. When the connector is mounted to the panel, portions of the panel edges bounding the cut out extend into the slots to retain the connector on the panel, while permitting longitudinal movement of the connector relative to the panel. It would be desirable to have an electrical connector for float mounting in a cut out of a mounting panel, that requires no additional parts to secure the connector housing in the panel. A panel lock could be moved from a first, unlocked position to a second, locked position to prevent movement of the connector in the cut out so the connector can be passed back out of the cut out. Ideally, the connector could be mounted to the panel without the aid of tooling.

SUMMARY OF THE INVENTION

According to one aspect of the invention, in an electrical connector housing having means for float mounting it in a cut out in a mounting panel, means are provided for arresting movement of the housing in the direction of an edge of the panel. The movement arresting means comprises a flange projecting from an end face of the housing and having a front face for engaging a face of the panel, and a rear face. A through socket is formed in the flange said socket opening into both of said front and rear faces, a first latching means being provided in a socket and a latching project on protruding into the socket. There is received in the socket, a one piece panel lock member having second latching means cooperating with the first latching means to restrain rearward movement of the panel lock member in the socket. A latch member within the socket projects from the panel lock member, a latch bar being resiliently connected to the panel lock. The panel lock member can be advanced forwardly in the socket to engage the latch bar in latching relationship with the latching projection and so to cause the panel lock to project beyond the front face of the flange. The projecting panel latch will extend into the plane of the panel and accordingly engage an edge of the cut out towards which the housing is moved, and thereby prevent any further movement of the housing in the direction of that edge.

The housing may accordingly be adapted for mounting in a T-shaped cut out in a panel in the manner described above, the panel lock, in the advanced position of the panel lock member serving to engage the continuous edge of the transverse part of the cut out thereby preventing the upper flanges of the housing from coming into alignment with said transverse part.

According to a preferred embodiment of the invention, the latch bar projects into the socket forwardly of the first latching means, the panel lock projecting beyond the latching projection and means being provided for limiting the advance movement of the panel lock member, such means comprising a shoulder on the housing located forwardly of the panel lock. The latching projection is rearwardly chamfered and has a forward shoulder for engagement by the latch bar in said latching relationship of the latching projection and the latch bar. The first latching means comprises a latching protrusion on each end of each two of opposite walls of the socket, the second latching means comprising a pair or rearwardly opening slots in the latch bar member, each slot having a forward end latchingly engaging the front of the respective latching protrusion.

The latch bar may be releasable from the latching projection by means of a tool, for example a pair of needle point pliers.

According to another aspect thereof, the invention relates to the latch bar member per se and to an electrical connector housing for float mounting in a T-shaped cut out in a mounting panel and being provided with a movement arresting means.

BRIEF DESCRIPTION OF THE DRAWING

FIGS. 11 to 13 are fragmentary sectional views illustrating details of the receptacle connector when it is being mounted to the second panel;

DESCRIPTION OF THE PREFERRED EMBODIMENTS OF THE INVENTION

An electrical connector assembly for making and breaking the supply of power to a drawer module containing circuitry of a computer power supply distribution unit, comprising a panel mounted, four position plug connector 2 and a panel mounted four position receptacle connector 4 will now be described with reference to the Figures, initially FIGS. 1 to 16.

The plug connector 2 is for mounting on a front panel P1 (see FIG. 2) of a fixed casing (not otherwise shown) for accommodating the connector 2. The receptacle connector 4 (see FIG. 8) is for mounting on a rear panel P2 (see FIG. 8) of the draw module which may be slideably mounted in a rack (not shown) of a computer. As explained below, the power supply to the module is completed when the module is operatively positioned in the rack, and is disconnected as the module is withdrawn therefrom.

Figure 1:
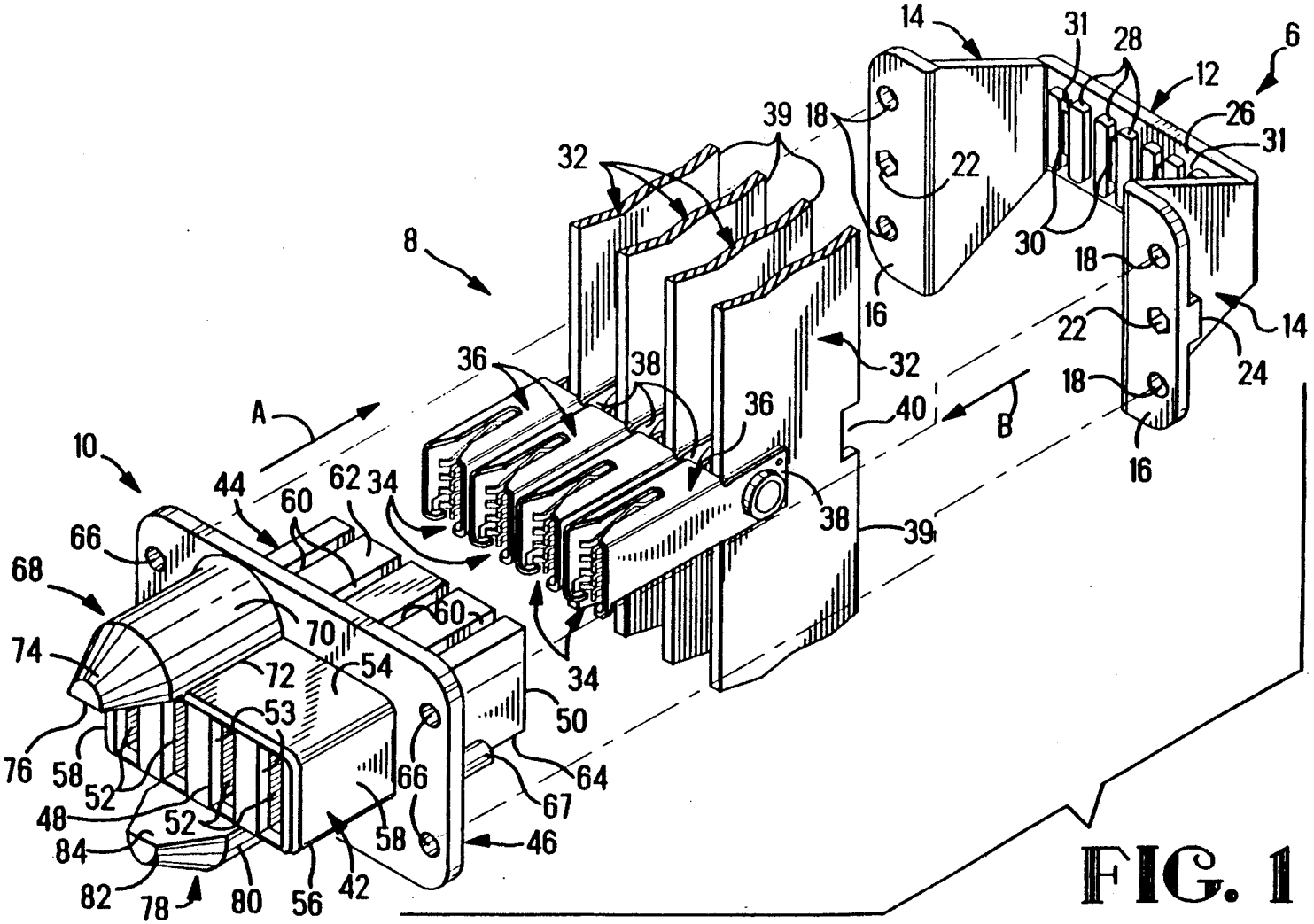
FIG. 1 is an exploded isometric view of a four position bus bar plug connector comprising a front insulating housing member, and intermediate bus bar and tulip contact assembly and a rear insulating housing member.
Figure 2:
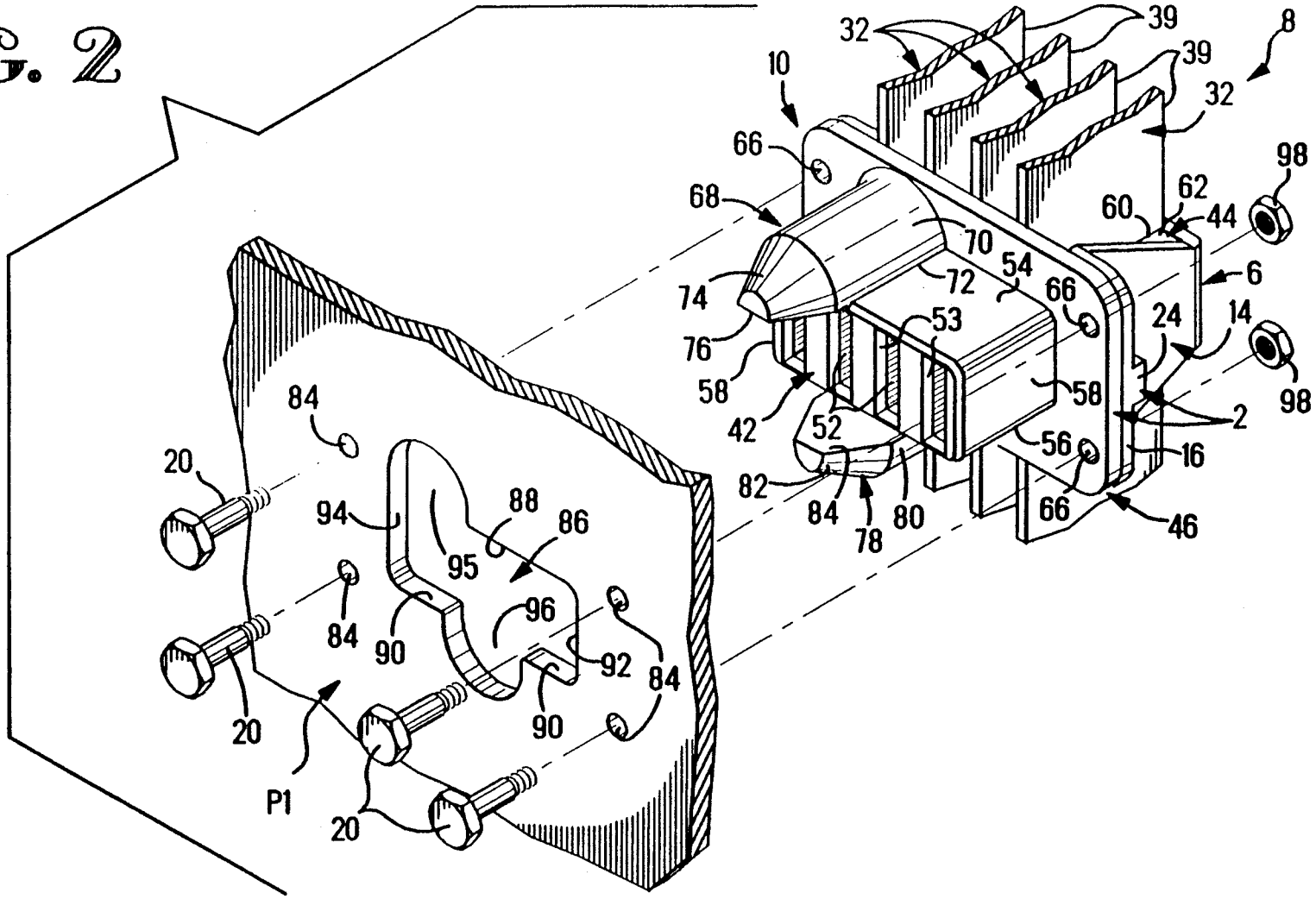
FIG. 2 is an exploded isometric view of the plug connector mounted to a first panel.

The plug connector 2 comprises, as best seen in FIG. 1, a one piece, molded, rear insulating housing member 6 and a one piece, molded, front insulating housing member 10, and may include a bus bar and tulip contact assembly 8. The rear housing member 6 comprises an elongate rectangular back plate 12 from each end of which projects a forwardly extending mounting lug 14 terminating in a mounting flange 16 substantially parallel with the back plate 12. Each mounting lug 14 is formed with a pair of vertically spaced, through holes 18 for receiving mounting bolts 20 (FIG. 2). Each flange 16 has between the holes 18 an aperture 22, which may be of hexagonal cross section as shown in FIG. 1. The aperture 22 extends into a rear projection 24 on the flange 16.

There project from the front face 26 of the back plate 12, a row of parallel, evenly spaced, elongate, transverse projections in the form of merlons 28 of equal length. Between each adjacent pair of merlons 28 is an elongate smaller rib 30 extending up from the floor of a crenel 31 extending parallel to the merlons 28 but being shorter than, and of smaller height than, the merlons 28. Each rib 30 is of equal width to the spacing between the merlons 28 and thus bridges the merlons between which it is disposed.

The bus bar and contact assembly 8 in the preferred embodiment comprises a row of four parallel, spaced, aligned power bus bars 32, and a row of four parallel, spaced, aligned, tulip, tab or receptacle, socket contacts 34, each having a slotted, tab receiving metal cover 36 from which extend a pair of legs 38 are on each side of a respective one of the bus bars 32. Contacts 34 are secured to respective bus bars 32 by locking inserts. Such tulip socket contacts are described in U.S. Pat. Nos. 4,045,509 and 4,753,615 which are hereby incorporated by reference. Three of the bus bars 32 are connected to respective power supply leads (not shown) of a three phase power supply, the remaining bus bar 32 being grounded. Approximately in line with the cover 36 connected thereto, each bus bar 32 has formed in its rear edge 39, a rectangular notch 40, the notches 40 being identical and being aligned with each other.

The front housing member 10 comprises a laterally elongate forward housing plug part 42, a similarly elongate rear housing part 44 and a flat, substantially rectangular peripheral flange 46 between the housing parts 42 and 44. The housing part 42 has a mating front face 48, the housing part 44 having a tulip contact and bus bar receiving face 50. Open into both of the faces 48 and 50 are a row of four vertically elongate, rectangular, tulip contact receiving cavities 52, each having a tab receiving entrance 53 at the face 48. The housing part 42 has a top wall 54, a bottom wall 56 and side walls 58, all of these walls being adjacent to the mating face 48. The rear housing part 44 is formed with a row of through, bus bar receiving upper and lower slots 60 opening into a top wall 62 and a bottom wall 64, respectively, of the housing part 44. Each slot 60 is aligned with, and communicates with a respective cavity 52. The flange 46 has proximate to each corner thereof, an aperture 66 for receiving a respective bolt 20. There projects from each side of the rear face of the flange 46, a cylindrical protrusion 67 midway between the holes 66 in that side. There extends forwardly from the flange 46, a first alignment member 68 having a rearward portion 70 in the form of a half circular cross section cylinder, the flat side 72 of which is formed integrally with the top wall 54. The member 68 has, projecting forwardly from its portion 70, a nose 74 in the form of a half cone which lies forwardly of the mating face 48. The flat side 76 of the nose 74 faces downwardly. A second alignment member 78 of the housing member 10, has a rearward portion 80 the same semicylindrical shape as the portion 70 of the member 68, projecting forwardly from the flange 46 and beneath the housing part 42. The flat side of rearward portion 80 is formed integrally with the bottom wall 56 of the part 42. There projects forwardly from the rear portion 80 of the member 78, and beyond the mating face 48, a nose 82 of the same semiconical shape as the nose 74. The flat side 84 of the nose 82 faces upwardly, that is to say in the opposite direction of the flat side 76 of the nose 74. The members 68 and 78 are offset longitudinally of the housing part 42, unsymmetrically with respect to the longitudinal center of the walls 54 and 56. In this manner, the alignment members 68 and 78 provide polarization of the front housing member 10 relative to a mating receptacle connector.

As shown in FIG. 2, the panel Pl has four through holes 84 arranged in quadrangular array, and spaced as holes 66 and 18, for receiving respective ones of the bolts 20. Between the holes 84, panel Pl has a cut out 86 having opposite, parallel, top and bottom edge 88 and 90, and end edges 92 and 94, respectively. At one end of the edge 88, the cut out 86 opens upwardly into an arcuate the first alignment member receiving recess 95 of substantially the same cross sectional shape and area as the rearward portion 70 of member 68. Near the other end of the edge 90, the cut out 86 opens downwardly into a second arcuate alignment member receiving recess 96 of substantially the same cross sectional shape and area as the rearward portion 80 of member 78.

Figure 4:
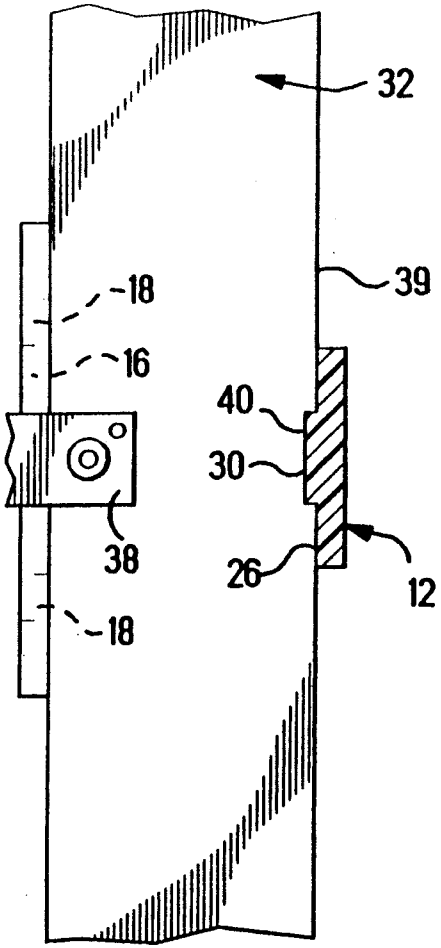
FIG. 4 is a similar view to that of FIG. 3 but showing the rear housing member when assembled to the bus bar and tulip contact assembly.
Figure 3:
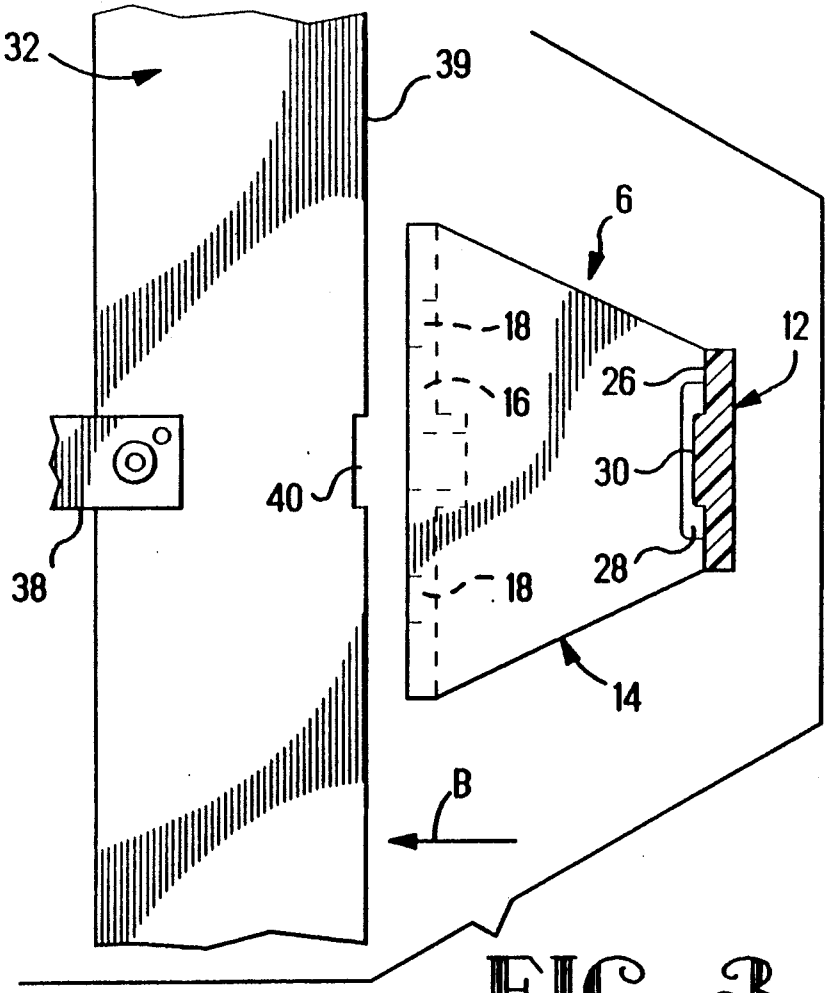
FIG. 3 is a fragmentary side view, shown partly in section, of the rear housing member about to be assembled to the bus bar and tulip contact assembly.

In order to assemble the housing members 6 and 10 to the bus bar and tulip contact assembly 8, each contact 34 with its cover 36 is inserted into a respective cavity 52 of the housing member 10, by way of the face 50, in the direction of the arrow A in FIG. 1, so that each bus bar 32 is received in respective upper and lower slots 60, as shown in FIG. 2. The contacts 34 and their covers 36 are simultaneously received in the housing portion 42, to an extent determined by the abutment of the forward edges of the bus bars 32 against the bottom of the respective slots 60. The housing member 6 is passed over bus bars 32 in the direction of the arrow B in FIGS. 1 and 3 until the rear edge 39 of each bus bar 32, adjacent to the notch 40 therein, is received between the merlons 28 of a respective adjacent pair thereof. At the same time, each rib 30 is snugly received in a respective notch 40 in said rear edge 39, as shown in FIG. 4.

Figure 6:
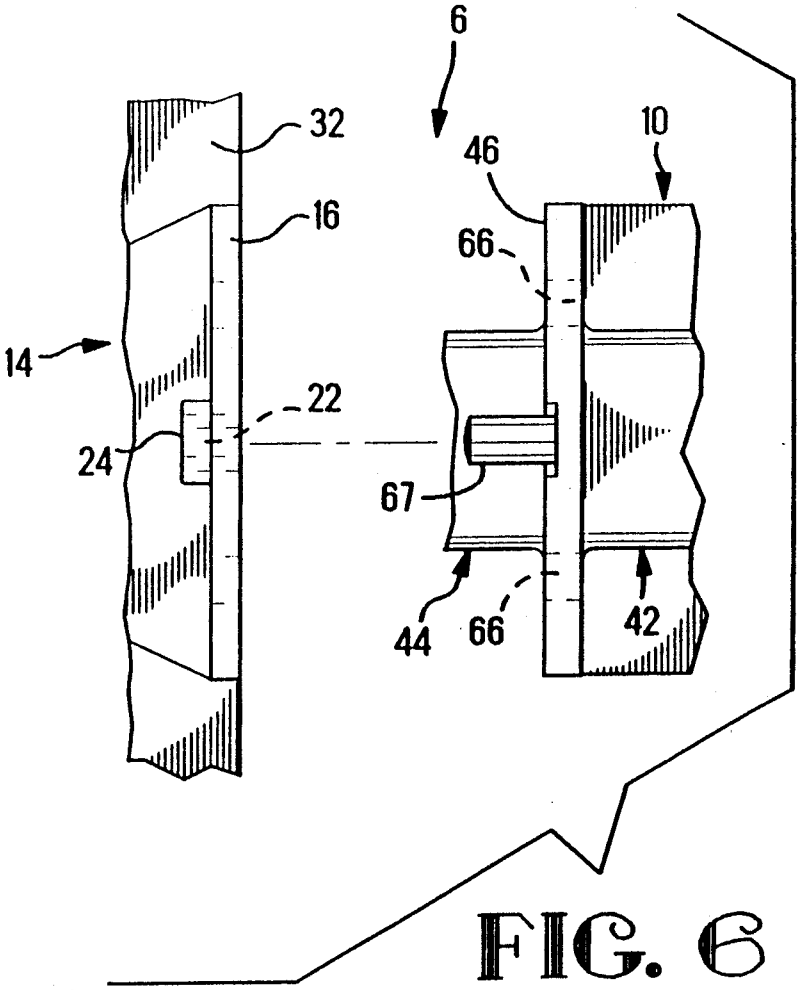
FIG. 6 is a fragmentary side view illustrating details of the front and rear housing members for holding said members together.
Figure 5:
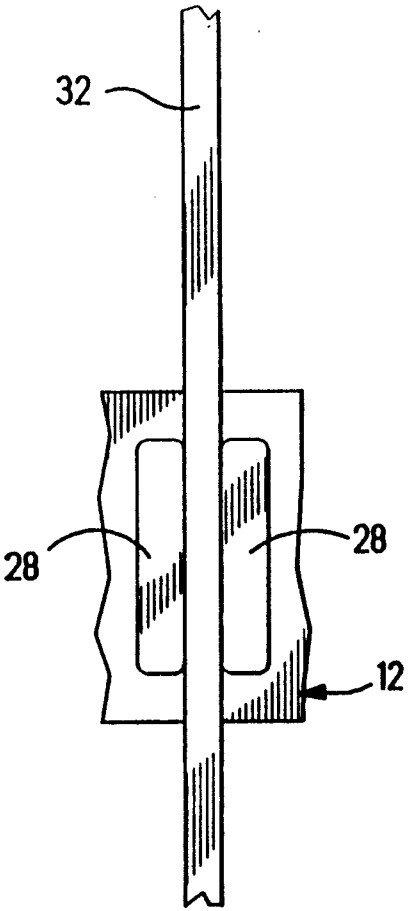
FIG. 5 is an end view of FIG. 4 with parts omitted.
Figure 7:
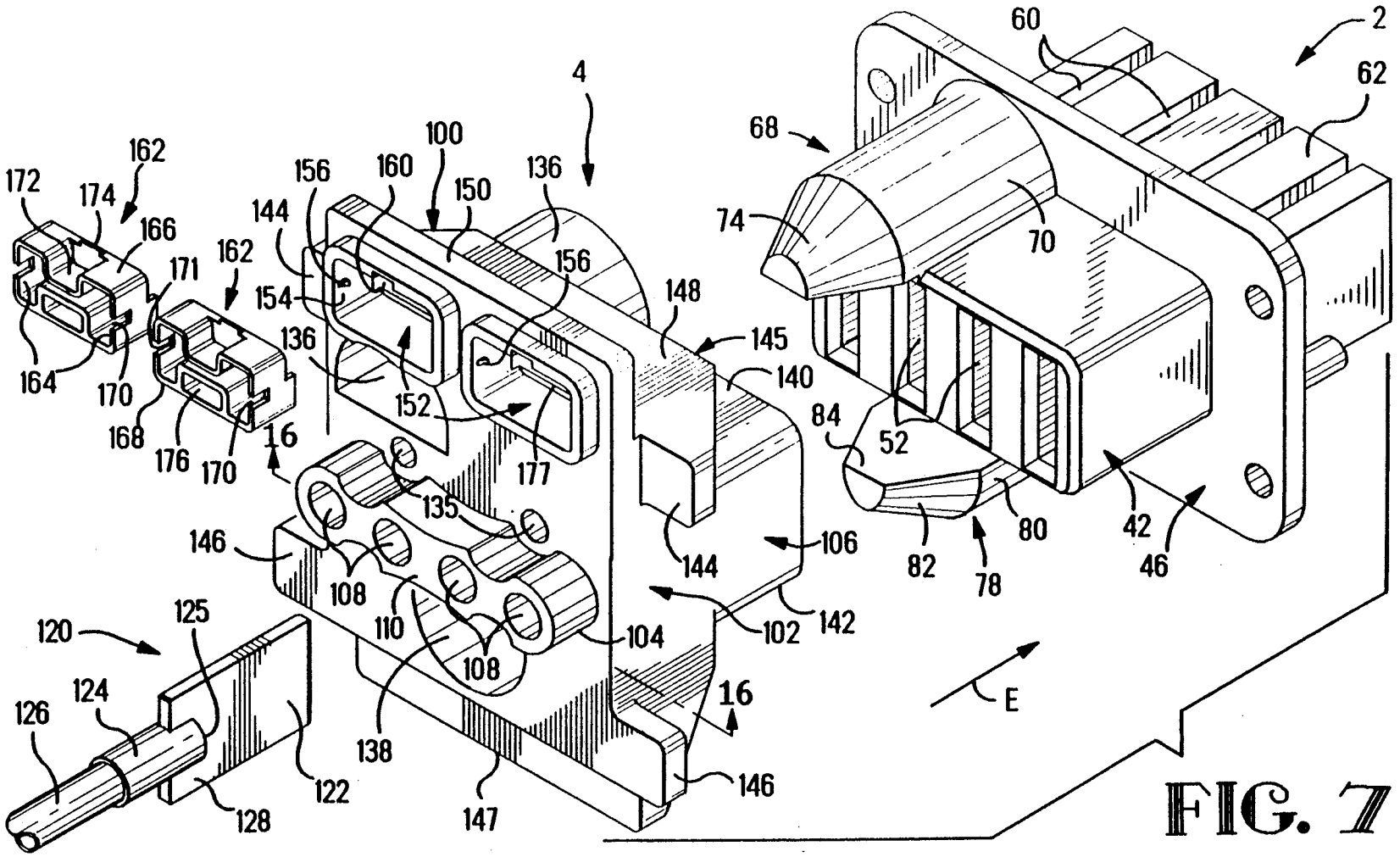
FIG. 7 is an isometric view showing the plug connector, with parts omitted, positioned for mating with a four position receptacle connector with parts exploded therefrom.

As will be apparent from FIG. 6, each cylindrical protrusion 67 of the housing member 10 is received in a respective aperture 22 of the housing member 6. The cylindrical protrusion 67 and the rear projection 24 are so relatively dimensioned that the cylindrical protrusions 67 engage in the flange and rear projection 24 in an interference fit, whereby the housing members 6 and 10 are temporarily held together about the assembly 8 in order to facilitate the mounting, described below, of the connector 2 to the panel P1. Cylindrical protrusions 67 could extend beyond the rear surface of rear projections 24 for heat staking as is known in the art. The merlons 28 maintain the lateral positions of the bus bars 32 so that they cannot move laterally so as to displace the rib 30 from the notches 40, as is apparent from FIG. 5. The weight of each bus bar 32 is supported by a respective rib 30.

With the connector 2 assembled as described above, the forward portions 74 and 82 of the alignment members 68 and 78 are inserted through the alignment member receiving recesses 95 and 96, respectively, of the cut out 86 of the panel P1 assisted by the rounded guide surfaces of the noses 74 and 82. The edges of the alignment member receiving recesses 95 and 96 slide along the rounded surfaces of the respective portions 70 and 80 of the alignment members 68 and 78, respectively, the walls 54 and 56 of the housing member 10 being received between the edges 88 and 90, respectively, of the cut out 86; until the panel P1 bottoms on the flange 46 of the housing member 10. Since the alignment members 68 and 78 are offset from each other longitudinally of the housing part 42, and are disposed on opposite top and bottom walls thereof, as described above, the housing member 10 can be assembled to the panel P1 only in a single correct orientation with respect thereto. In this manner, the offset alignment members provide a polarization function with respect to the panel cutout 86, in addition to providing as mentioned above a polarization function relative to a mating connector. When the connector 2 has been assembled as described above, to the panel P1, the bolts 20 are inserted through the respective aligned sets of holes 84,66 and 18 in the panel P1, the flange 46 and the flanges 16, respectively. Nuts 98 are threaded on to the bolts 20 to secure the members 6 and 10 fixedly about the assembly 8 and to secure the connector 2 fixedly to the panel P1 to which the weight of the bus bars 32 has now been transferred.

Figure 14:
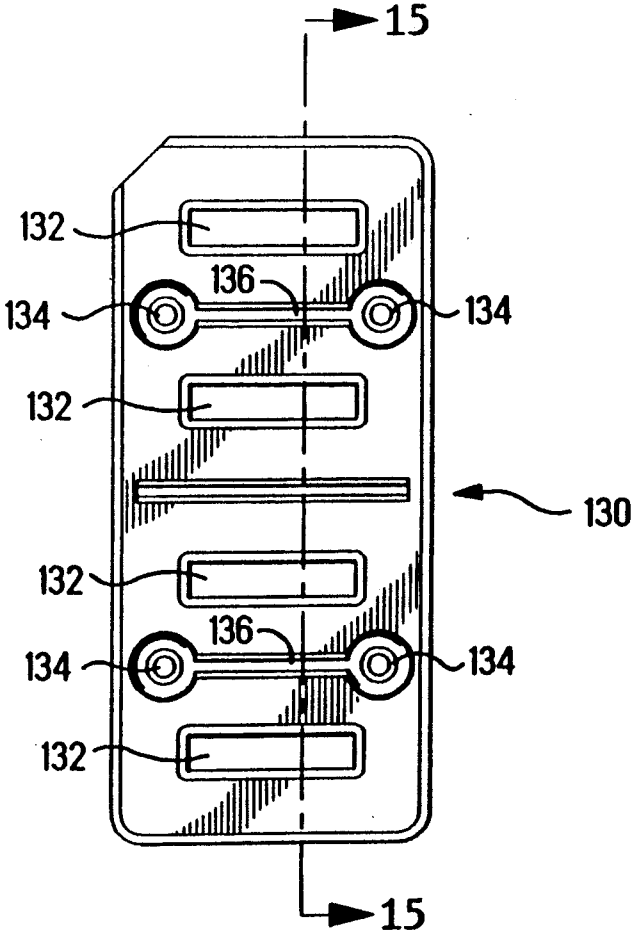
FIG. 14 is a plan view of a front cover plate of the receptacle connector.
Figure 15:
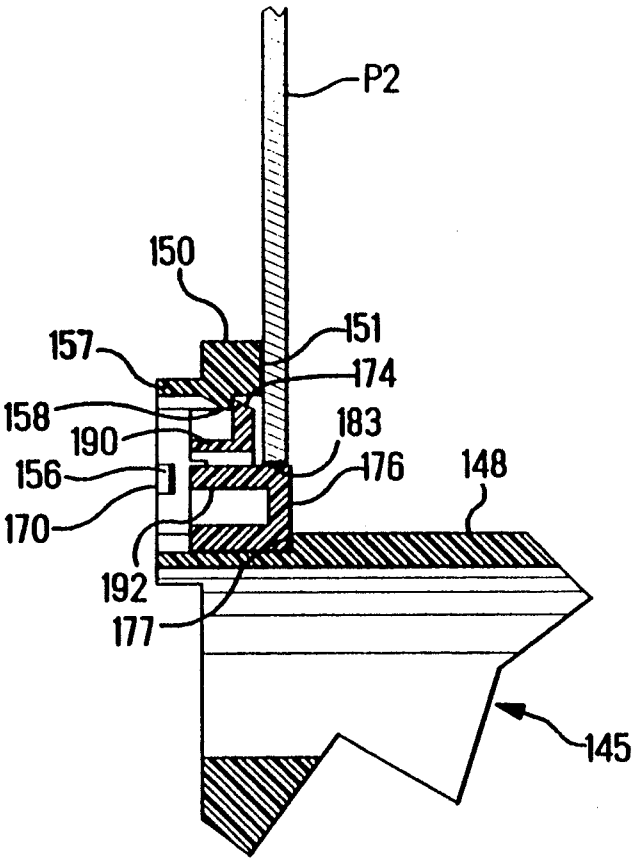
FIG. 15 is a view taken on the lines 15—15 of FIG. 14.
Figure 16:
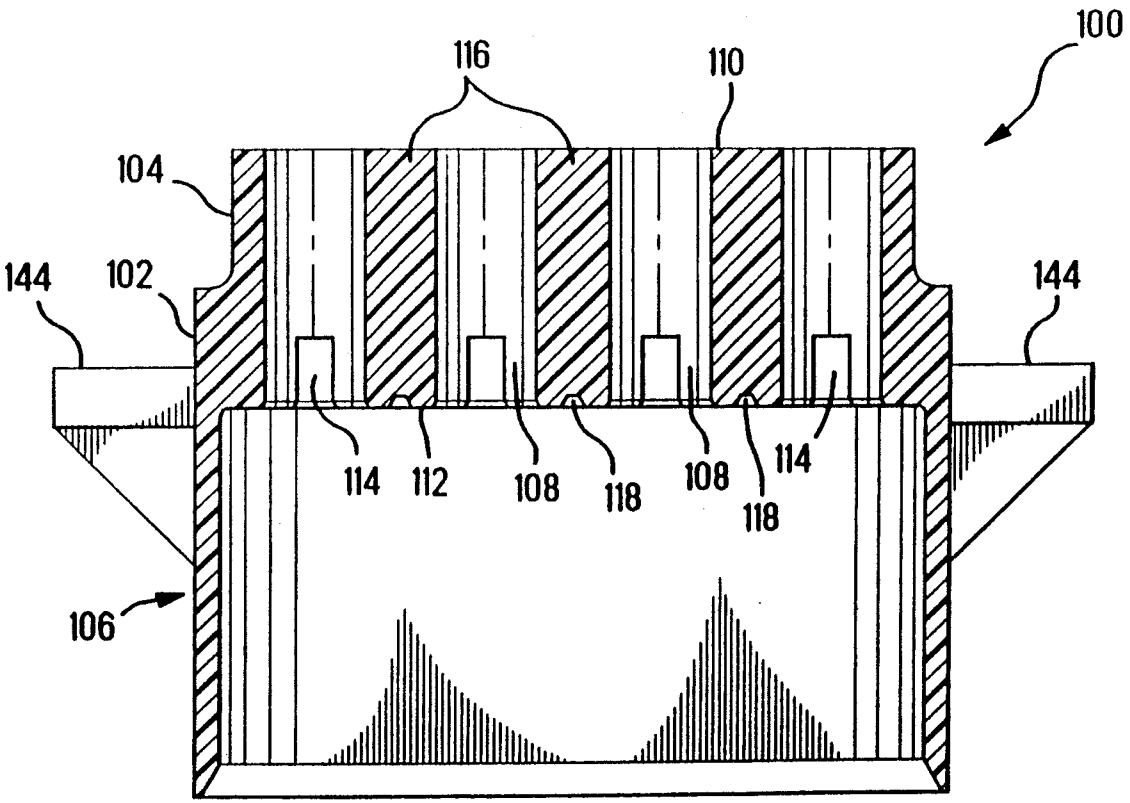
FIG. 16 is a view taken on the lines 16—16 of FIG. 7.
Figure 15:
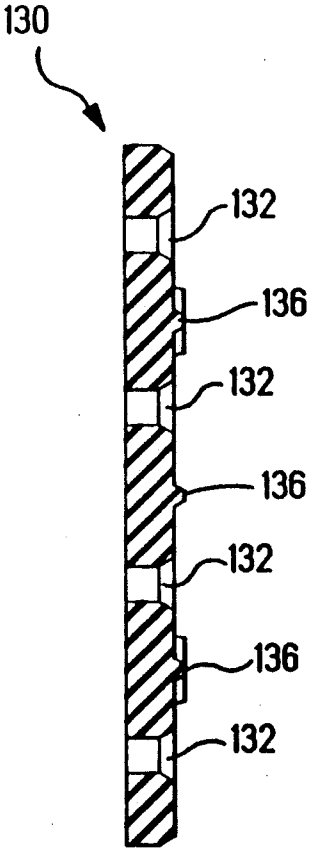
Figure 17:
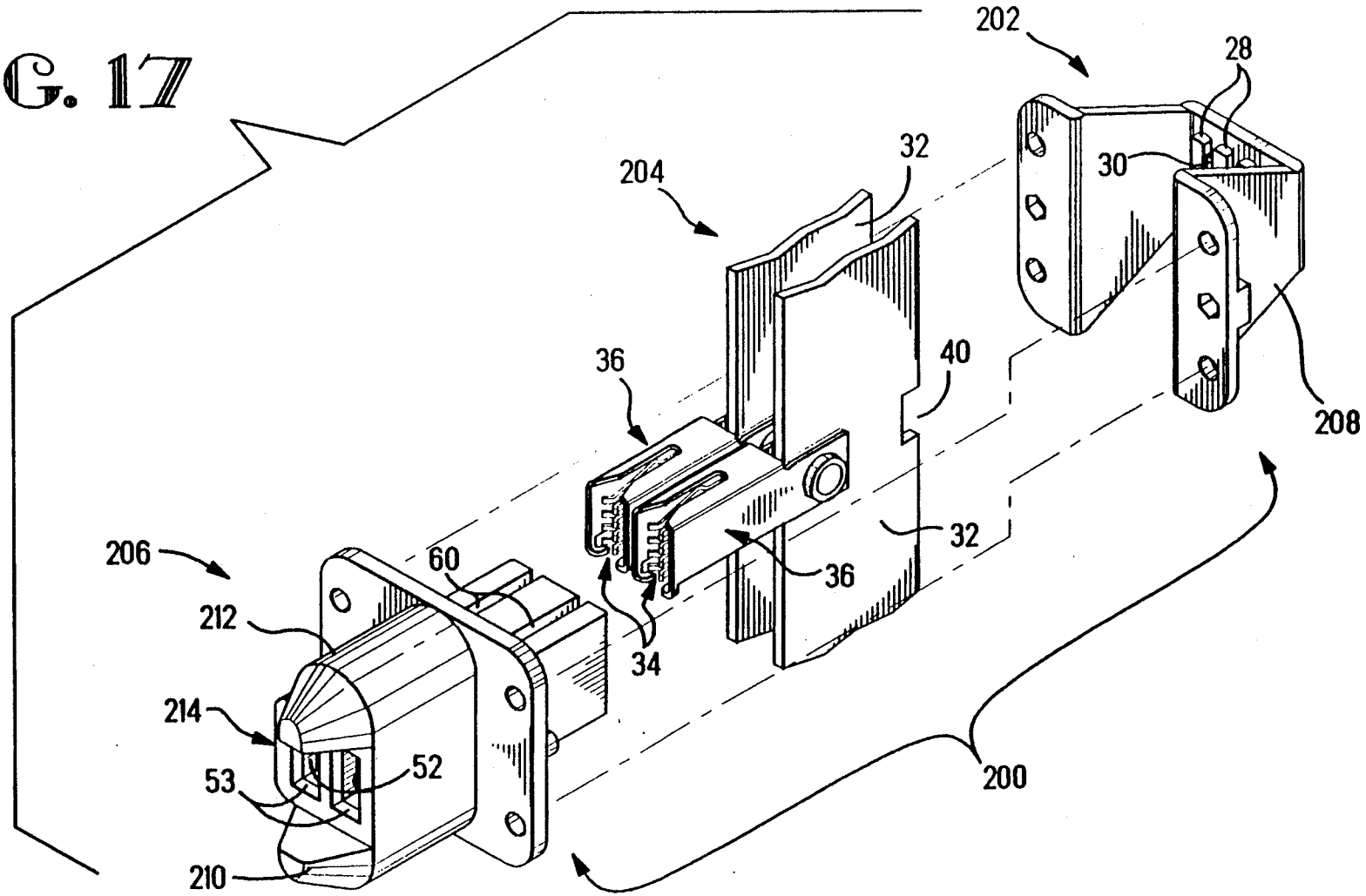
FIG. 17 is an exploded isometric view of a two position bus bar plug connector comprising a front insulating housing member, an intermediate bus bar and tulip contact assembly and a rear insulating housing member.
Figure 18:
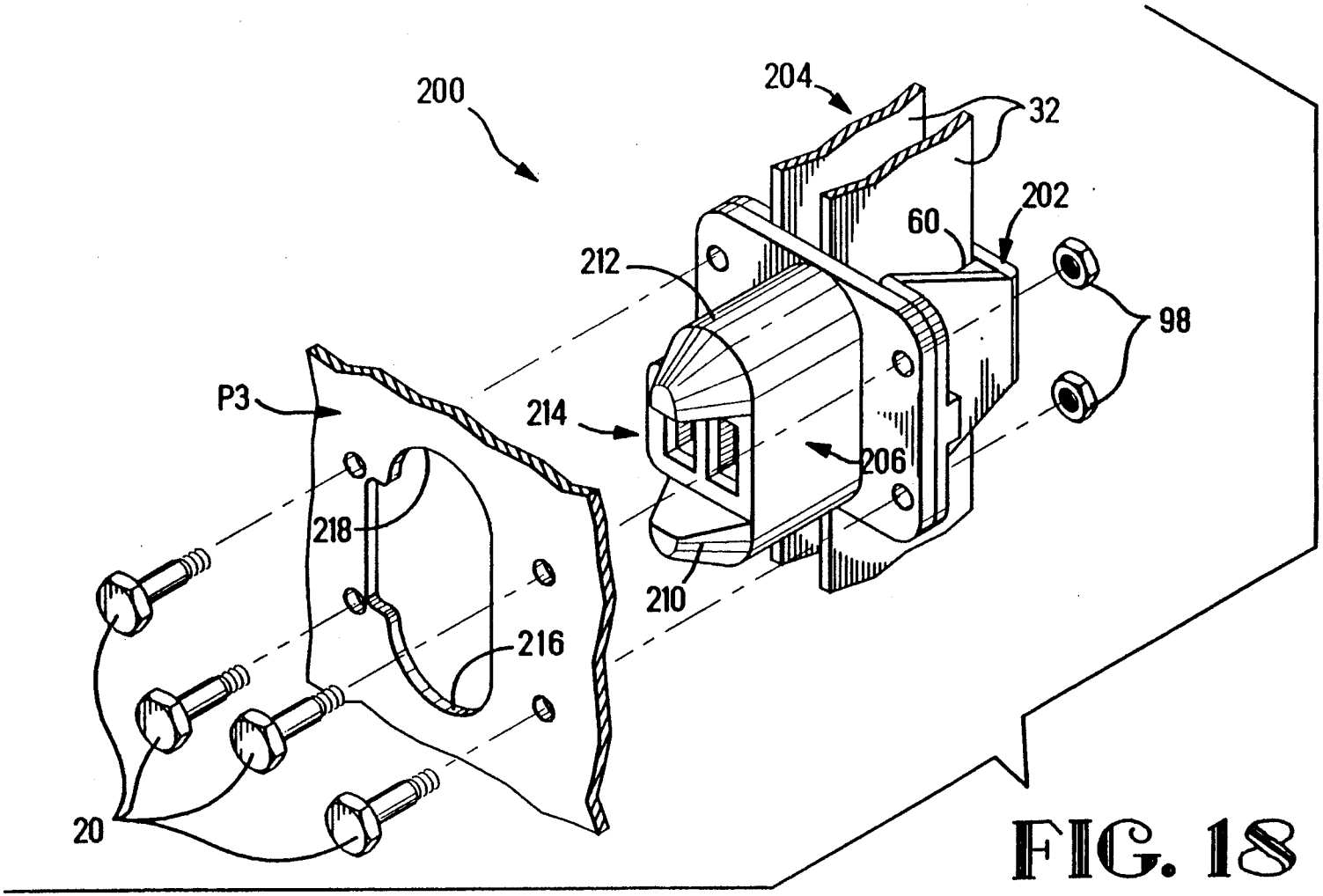
FIG. 18 is an exploded isometric view illustrating the connector of FIG. 17 when mounted to a third panel.

The mating connector 4 and its assembly to the panel P2 will now be described with a particular reference to FIGS. 7 to 16. The receptacle connector 4 comprises one piece insulating housing 100 having a tab contact receiving rear part 102 from which projects rearwardly thereof, a lead receiving block 104, and forwardly thereof a shroud 106 for receiving the plug part 42 of the connector 2. As best seen in FIG. 16, four through cavities 108 extend through the housing part 102 and the block 104, each opening into a rear face 110 thereof and into an opposite tab contact receiving face 112 which forms the base of the shroud 106. In the upper wall each cavity 108 is a rectangular recess 114. The cavities 108 are separated by barrier walls 116, some of which are formed with a front plate locating groove 118 opening into the face 112.

Four tabs contacts 120 (only one of which is shown, in FIG. 7), each comprises a tab 122 and a crimping ferrule 124 crimped to an insulated electrical power lead 126. There projects outwardly from the rear end of the tab 122, adjacent to the ferrule 124, a rectangular anchoring lug 128.

Each contact 120 is located into a respective cavity 108 by passing the lead 126 of the contact 120, through said respective cavity 108 by way of the face 112 in the shroud 106, so that the lead 126 extends beyond the rear face 110, and then pulling on the lead so that the lug 128 of the contact 120 lodges in the corresponding recess 114. As shown in FIGS. 14 and 15, a front cover plate 130 for receiving against face 112 has four rectangular apertures 132 therethrough, each for receiving therethrough a respective tab 122. Each aperture 132 has a beveled lead-in. Between each of two adjacent pairs of the apertures 132 are two spaced circular holes 134 and extending therebetween is a front cover plate guide rib 136. When the contacts 120 have been loaded into the cavities 108, as described above, the front plate 130 is located on the face 112 with tabs 122 extending through the apertures 132. Each rib 136 is received in a corresponding groove 118, after which the plate 130 is riveted on the face 112 by means of rivets passed through the holes 134 and into openings 135 (FIG. 7) in the rear housing part 102. The chordal surface 125 of ferrule 124 is wider than rectangular apertures 132 and secures contact 120 in connector 4.

Figure 8:
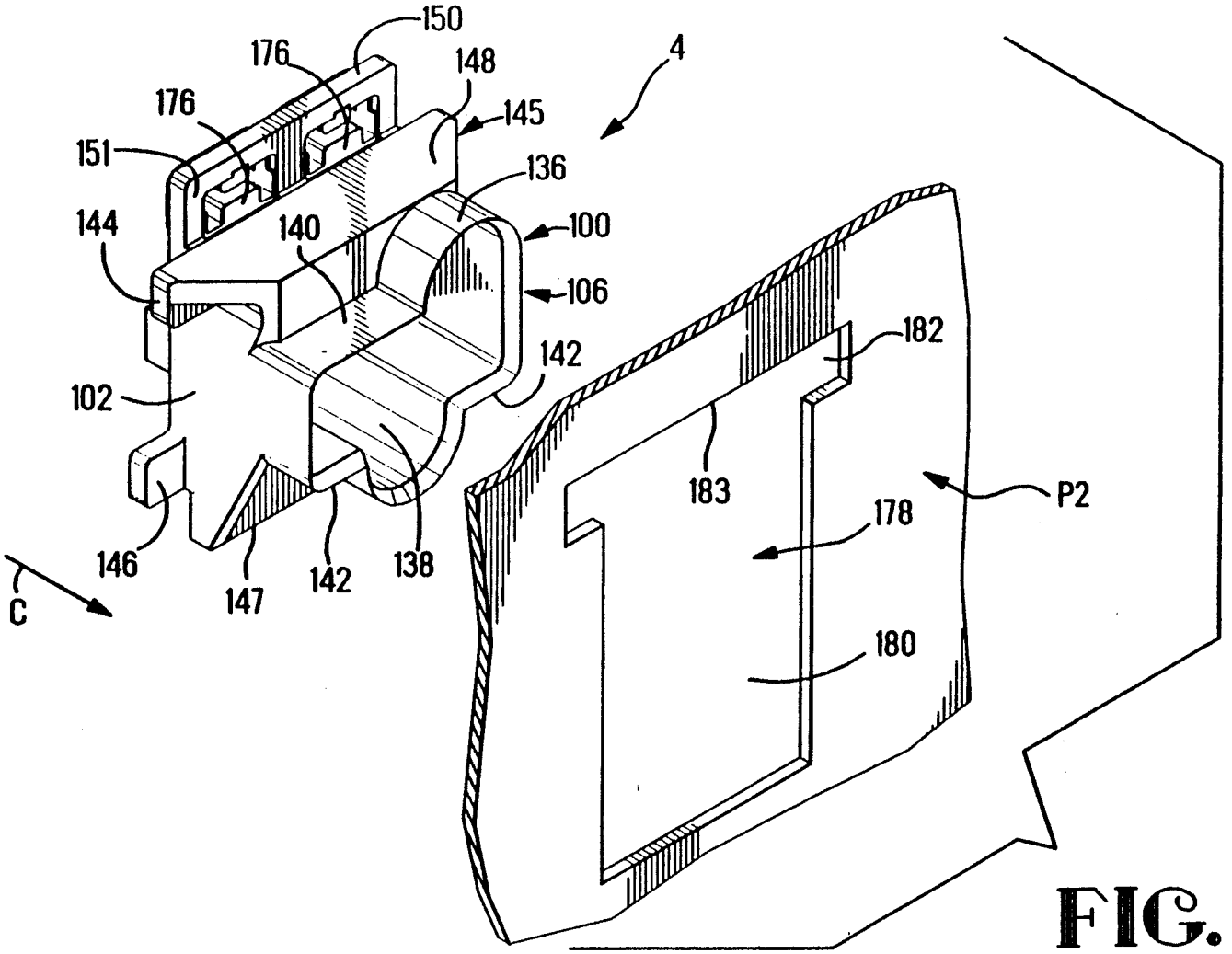
FIGS. 8 to 10 are isometric views illustrating respective consecutive steps in mounting the receptacle connector to a second panel.
Figure 9:
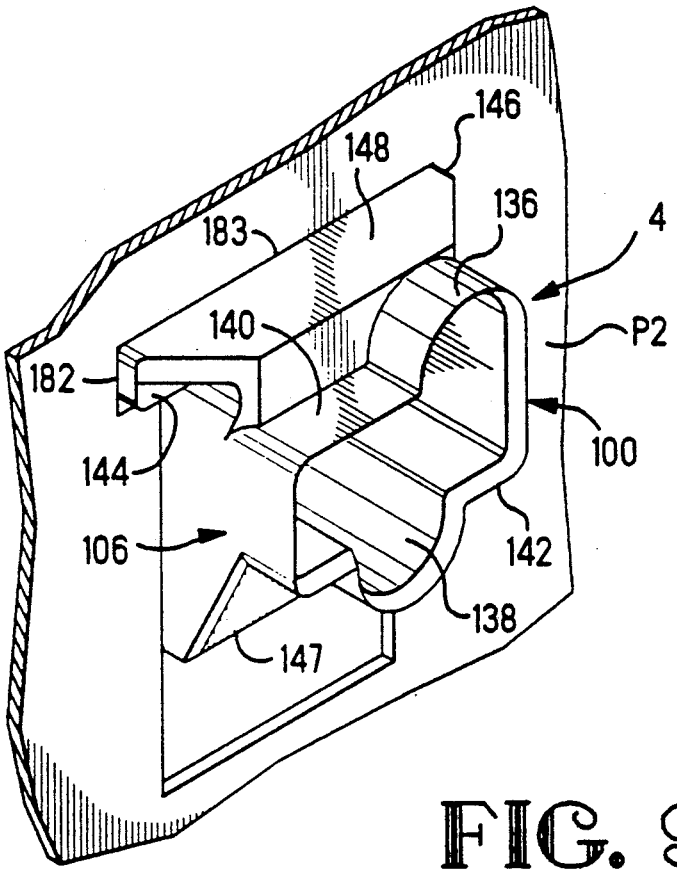
Figure 10:
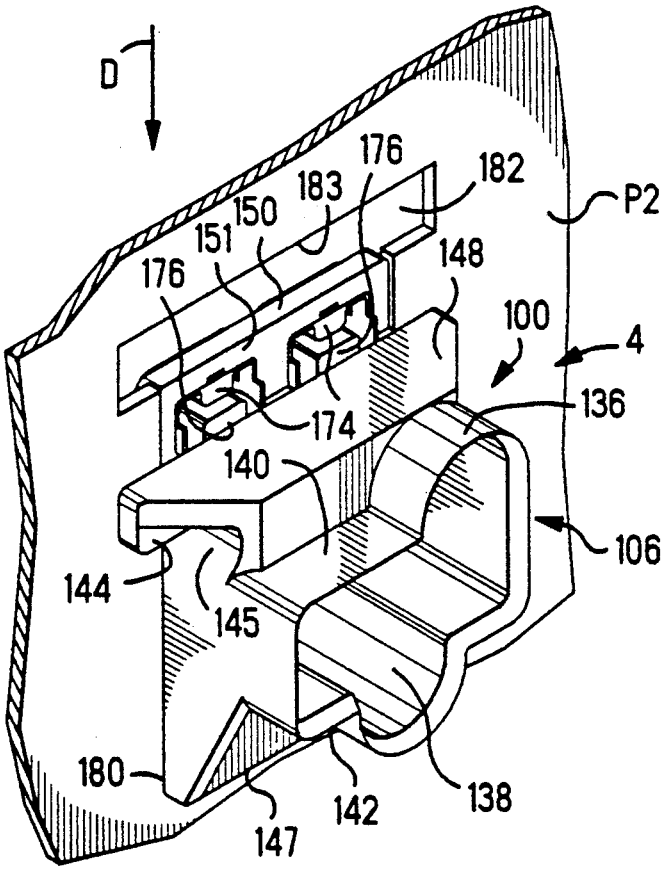

As best seen in FIGS. 8 to 10, the shroud 106 is formed with two arcuate alignment member receiving arcs 136 and 138, respectively, projecting upwardly, and downwardly, respectively, from respective top and bottom walls 140 and 142 of the shroud 106. The arc 136 is offset from the arc 138 longitudinally of the shroud 106, to the same extent that the alignment members 68 and 70 of the housing member 10 are offset from each other as described above. The alignment member receiving arcs 136 and 138 are dimensioned to receive the alignment members 68 and 78, respectively in a close fit.

There projects from the part 102 of the housing 100 panel engaging front upper flanges 144 and rear panel engaging lower flanges 146. The flanges 144 are spaced forwardly of the flanges 146 by a distance substantially the same as or slightly greater than the thickness of the panel P2, and are proximate to a bottom face 147 of the housing 100. The flanges 144 extend from opposite ends of a forward cross piece 145 on the housing part 102 and beyond the lateral ends of the part 102. There upstands from the housing part 102, above a top wall 148 of the cross piece 145, and rearwardly thereof, a latch member receiving flange 150 having two laterally spaced, through, latch member receiving sockets 152 of substantially rectangular cross section. Each socket 152 has on each of two opposite side walls 154 thereof, a rearwardly chamfered latching protrusion 156, and on a top wall 157 thereof, a rearwardly chamfered latching projection 158 (FIGS. 11 to 13) in a recess 160.

Figure 12:
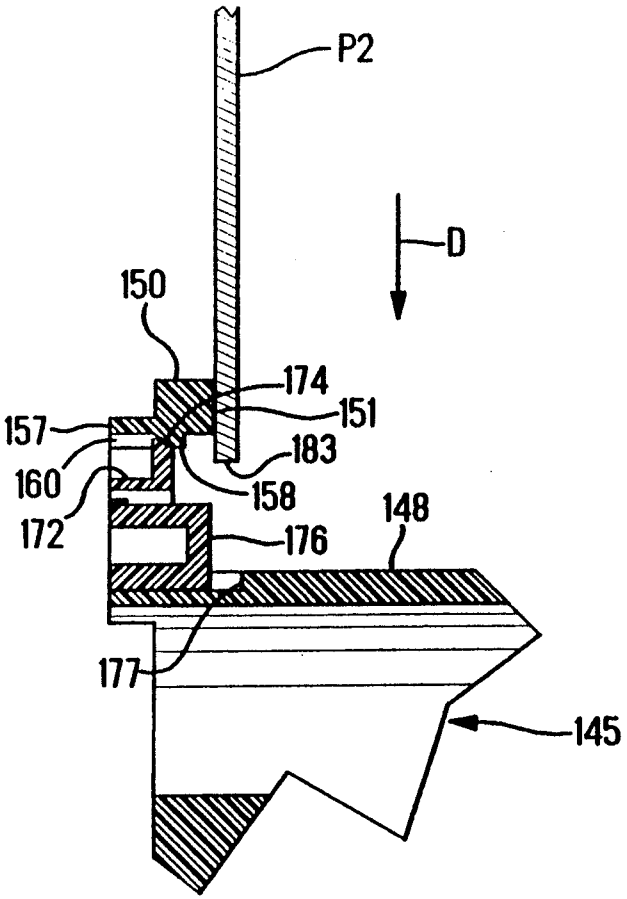
Figure 11:
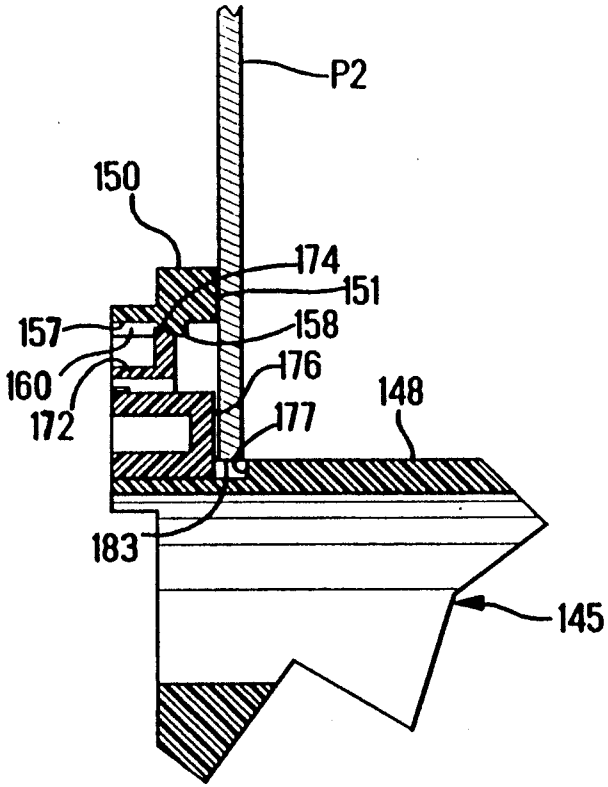

A panel lock member 162 factory loaded into each socket 152 comprises side walls 164 connected by a top wall 166 and a bottom wall 168. Each side wall 164 has a rearwardly opening latching slot 170 having a forward latching end 171. There is formed in the top wall 166 an L-shaped front latch 172 terminating in a latch bar 174. The bottom wall 168 is formed with a hollow substantially rectangular latch member 176 projecting forwardly beyond the latch bar 174. In front of the latch member 176, the top wall 148 of the cross piece 145 has a longitudinally extending stop shoulder 177 which is best seen in FIGS. 11 to 13. In the factory loaded, preload position of each panel lock member 162, the ends of the slots 170 of the panel lock member 162 are engaged in front of respective latching protrusion 156 in the respective socket 152, the latch bar 174 of each latch member 162 engaging a chamfered rearward edge of the respective latching projection 158. The latch bolt member 176 is thus in a withdrawn, rearward, position as shown in FIG. 11.

The panel P2 to which the connector 4 is to be mounted has a T shaped cut out 178 best seen in FIG. 8. The T shaped cutout has a wider upright part 180 and a narrower transverse part 182. The transverse part has a top edge 183. In order to mount the connector 4 to the panel P2, the connector 4 is moved towards the panel P2 from its rear side within the drawer, in the direction of the arrow C in FIG. 8, so that the shroud 106 projects through the upright part 180 of the cut out 178 and beyond the front face of the panel P2, the cross piece 145 extending through the transverse part 182 with the flanges 144 lying just in front of the panel 2. The flanges 146 engage against the rear face of the panel P2 and the front face 151 of the flange 150 also engages against the rear face of the panel P2 as is apparent from FIGS. 9 through 13.

As shown in FIGS. 10 and 12, the connector 4 is moved down towards the bottom of the upright part 180 of the cut out 178, as indicated by the arrows D in FIGS. 10 and 12, whereby the connector 4 is held in the cut out 178 by the engagement of the top front flanges 144 against opposite sides of the front face of the panel P2 and by the engagement of the bottom rear flanges 146 against opposite sides of the rear face of the panel P2. The connector 4 can, however, float upwardly and downwardly in the cut out 178, and to a lesser extent laterally therein. In order to prevent the connector 4 from being raised to the extent that the cross piece 145 is again located in the transverse part 182 of the cut out 178 so that the connector can fall out of the panel P2, the panel lock members 162 and thus the latch members 176 are advanced to a forward position, that is moved into the plane of panel P2 by means of a suitable tool to the position in which they are shown in FIGS. 10 and 13. As the latch bolts 176 are being so advanced the latch bars 174 of the latches 172 ride up the chamfered surfaces of the latching projections 158 and lodge in front of forward shoulders thereof as shown in FIG. 13, so that the latch bolt members 163 are retained in their advanced positions between the projections 158 and the stop shoulder 177. In the position, the latch members 176 project beyond the front face of the flange 150 into the plane of panel P2 with the lower parts of the forward ends of the latch bolt 176 engaging the stop shoulder 177.

The upward movement of the connector 4 in the cut out 178 is accordingly limited by the abutment of the forward parts of the top faces of the latch member 176 against the top edge 183 of the transverse part 182 of the cut out 178, as shown in FIG. 13. The cross piece 145 cannot, therefore, enter the part 182 to such an extent that the connector 4 can fall from the panel 2. Connector 4 can still shift toward surface 183 but to a lesser extent than when latch members 176 were in their factory loaded position.

If the connector 4 is to be removed from the panel 2, a tool, for example needle point pliers, can be used to grip oppositely facing surfaces 190 and 192 (FIG. 13) of the latch 172 and the latch member 176 of each panel lock member 162 in turn, thereby to release the latch bar 174 of each panel lock member 162 from the corresponding projection 158, so that the tool can be used to withdraw the panel lock member 162 to its rearward, factory loaded position in which it is held in place by the engagement of the latch bar 174 against the chamfered rear surface of the projection 158 and the engagement of the ends of the slots 170 in front of the respective latching protrusion 156.

When the connector 4 has been assembled to the panel P2 as described above, the leads 126 are connected to appropriate circuitry of the drawer module. The drawer can then be closed so that the connector 4 is mated with the connector 2 which is located in the rack and behind the rails on which the drawer moves. As the drawer is being closed, the connector 4 is mated with the connector 2 in the direction indicated by the arrow E in FIG. 7 (in which Figure the panels and the housing member 6 and assembly 8 of the connector 4 are not shown). Alignment members 68 and 78 of the connector 2 are received in the alignment member receiving arcs 136 and 138, respectively of the connector 4, guided by the noses 74 and 82 of the alignment members 68 and 78, respectively, thence alignment members 68 and 78 whereby each tab 122 of the connector 4 is mated with a respective tulip contact 34 of the connector 2 thereby connecting the bus bars 32 to the appropriate circuitry of the power supply module in the drawer. In the event of misalignment between the connectors 2 and 4, the tapered noses 74 and 82 of the alignment members 68 and 78 engage in the alignment member receiving arcs 136 and 138, respectively, of the connector 4 so as to bring the alignment member receiving arcs into alignment with the alignment members, given that the connector 4 can float both vertically and horizontally in the panel P2 although the connector 2 is affixed to the panel P, since the weight of the bus bars 32 would, in any event, not allow it to float. When the drawer is pulled out the connectors 2 and 4 are unmated.

Since the alignment members 68 and 78 and the alignment member receiving arcs 136 and 138 are offset in the manner described above, the connectors 2 and 4 can only be mated in a single correct orientation with respect to each other. If the housing member 10 were incorrectly mounted with its alignment member 78 uppermost to a panel having corresponding alignment member receiving arcs, the connector 2 could not be mated with the connector 4.

A two position version of the connector assembly described above, such as for connecting a DC power supply to a drawer mounted DC power supply module, will now be described with reference to FIGS. 17 to 21. In FIGS. 17 to 21, elements which are identical to those described above with reference to FIGS. 1 to 16, bear the same reference numerals as in those Figures.

Figure 19:
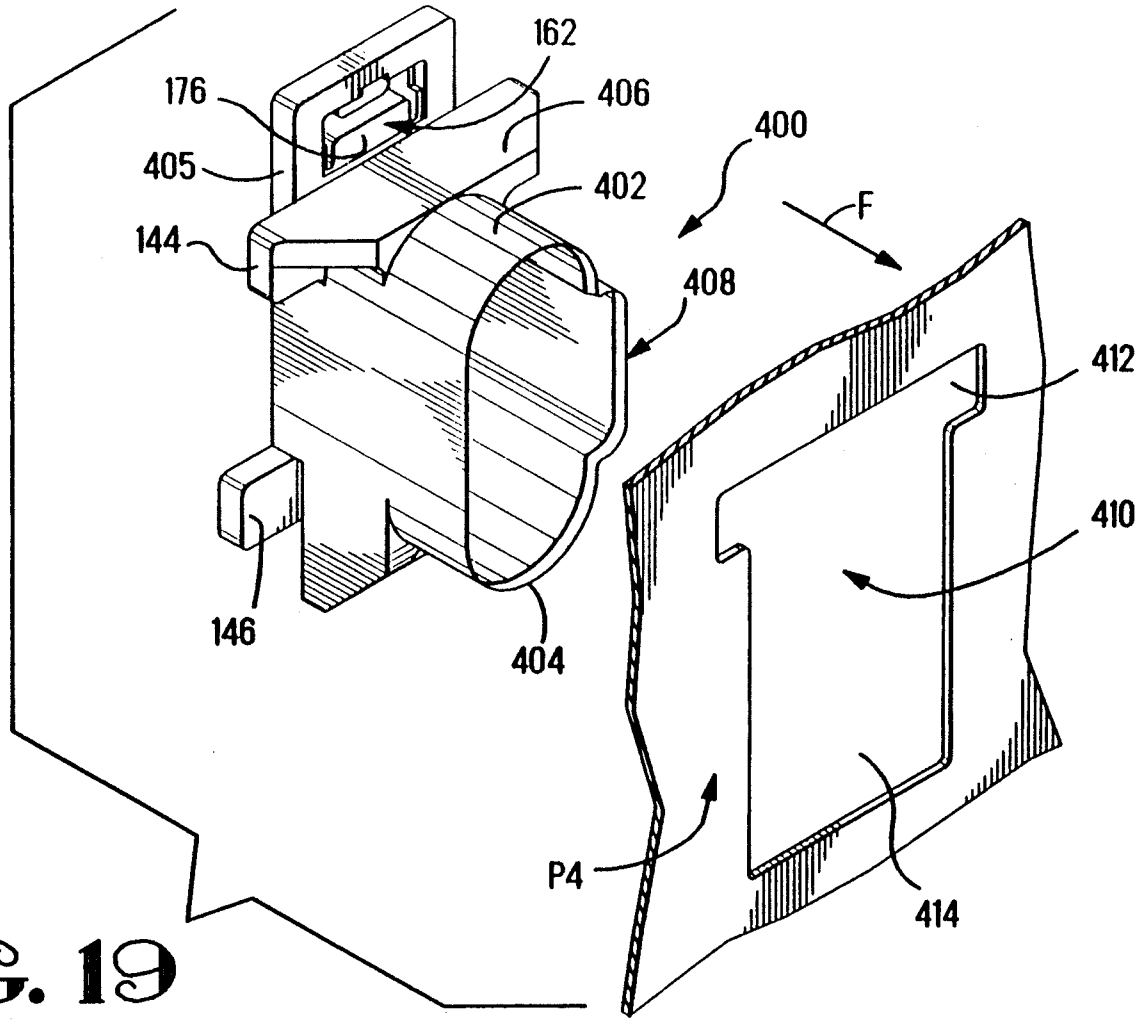
FIGS. 19 to 21 are isometric view illustrating respective consecutive steps in mounting a two position receptacle connector to a fourth panel, for mating with the connector of FIG. 17 and 18.
Figure 20:
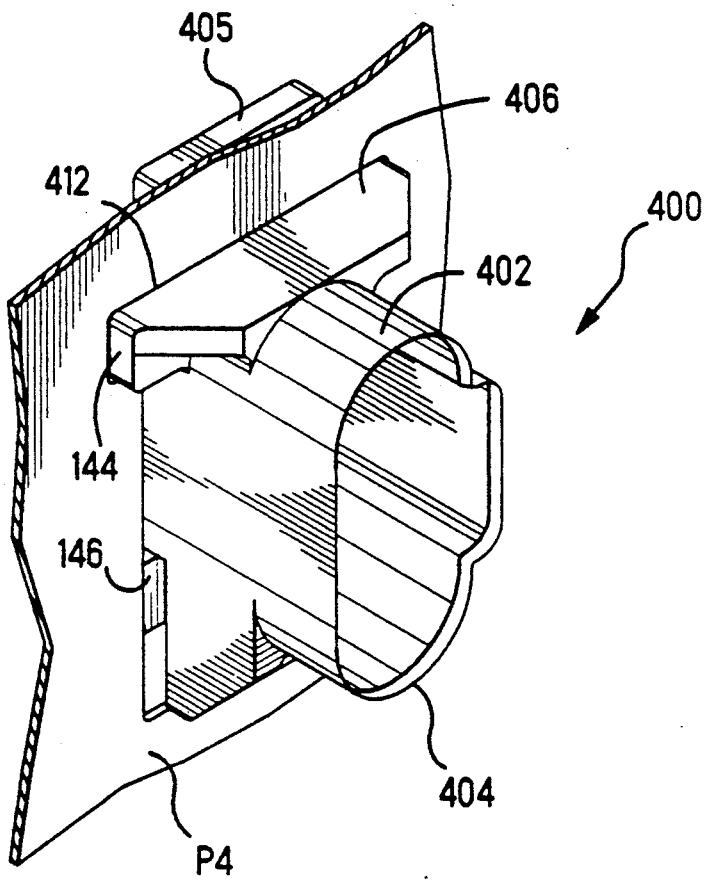
Figure 21:
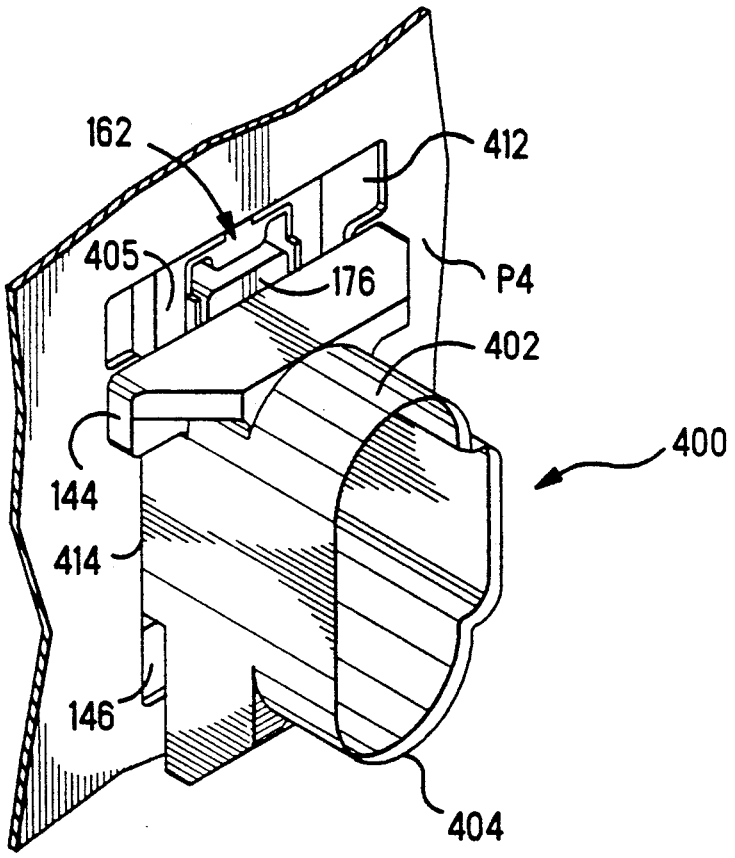

A plug connector 200 (FIGS. 17 and 18) is provided for mating with a receptacle connector 400 (FIGS. 19 to 21). The plug connector 200 comprises rear housing member 202 and a front housing member 206, and may include an intermediate tulip contact and bus bar assembly 204.

The rear housing member 202 differs from the rear housing member 6 described above, in that its back plate 208 has correspondingly only three merlons 28 and thus only two crenels 31 with ribs 30 therein. The assembly 204 differs from the assembly 8 in that it has correspondingly only two bus bars 32 and only two tulip contacts 34, the bus bars 32 being for connection to opposite poles of a DC power supply.

The front housing member 206 differs from the front housing member 10, in that is has only two pairs of slots 60, one for each bus bar 32 and only two cavities 52 each for receiving a tulip contact 34 and its cover 36. Also, the housing member 206, instead of the alignment members 68 and 78 has a pair of alignment members 210 and 212 positioned on either side of its forward housing part 214. Each alignment member 210 and 212 has a laterally outer rounded surface for engaging in a respective similarly configured alignment member receiving recess 216 and 218 in a panel P3. Likewise, the receptacle connector 400 has a pair of opposed alignment member receiving arcs 404 and 402 for receiving the alignment members 210 and 212, respectively, of the connector 200. In view of its reduced width, with respect to the connector 4, the connector 400 has but a single panel lock member 162 in its top flange 405. The connector 400 is mounted to a panel P4 the same way as the connector 4 is mounted to the panel P2, the cross piece 406 of the connector 400 and its shroud 408 being initially inserted in the direction of the arrow F in FIG. 19, through a T-shaped cut out 410 in the panel P4 with the cross piece 406 in the transverse part 412 of the cut out 410 and the shroud 408 in the upright part 414 of the cut out 410 as shown in FIG. 20. The connector 4 is then moved down in the cut out 410 as shown in FIGS. 19, 20 and 21 allowing the latch member 176 of the panel lock member 162 to be advanced, so that the connector 400 cannot be raised to an extent that it falls out of the panel P4.

While the connectors in the preferred embodiment have been described as having the structure to receive multiple bus bars and tulip contacts, a connector in accordance with the invention could have only one bus bar and thus only one tulip contact, the receptacle connector having only one tab contact; in this case a plurality of receptacle connectors could be mounted to the drawer back panel for mating with a like plurality of plug connectors.

The plug connector could be provided with male contacts, the receptacle connector being provided with female contacts.

The connector on the drawer back panel could be in the form of a plug connector, the connector for mating therewith being in the form of a receptacle connector.

While the preferred embodiment of the invention has been described with respect to a T shaped panel cut out having a vertical part and a transverse part, the cut out could be oriented at any angle with reference to the vertical. The disclosure has been of the preferred embodiment and is a matter of convenient disclosure.

While the preferred embodiment has been described with respect to a float mount connector, it is recognized that the panel lock disclosed herein can be used to secure a connector to a panel that does not provide float in the mount. Such a mounting would have a panel cut out that is substantially the size required for the connector and panel lock. This would provide a screwless mount for a connector.

We claim:

1. In an electrical connector housing having means for float mounting it in a cut out in a mounting panel, means for arresting movement of the connector housing in the direction of an edge of the cut out, said movement arresting means comprising:

a flange projecting from an end face of the housing and having a front face for engaging a face of the panel and a rear face, a through socket formed in said flange opening into both of said front and rear faces, first latching means in the socket and a latching projection protruding into the socket; and a one piece panel lock member received in the socket and having second latching means cooperating with a first latching means to restrain rearward movement of the panel lock member in the socket, a panel lock within the socket projecting forwardly from the panel lock member and a latch bar resiliently connected to the panel lock, the panel lock member being advanceable forwardly in the socket to engage the latch bar with the latching projection in latching relationship therewith and so to cause the panel lock to project forwardly beyond the front face of the flange.

2. Movement arresting means as recited in claim 1, wherein the latch bar protrudes into the socket forwardly of the first latching means, the latch bar projecting beyond the latching projection.

3. Movement arresting means as recited in claim 1, wherein the advance of the panel lock member is limited by a shoulder on the housing located forwardly of the panel lock.

4. Movement arresting means as recited in claim 1, wherein the latching projection is rearwardly chamfered and has a forward shoulder for engagement by the latch bar to provide said latching relationship.

5. Movement arresting means as recited in claim 1, wherein the first latching means comprises a latching protrusion on each of two opposite side walls of the socket, the second latching means comprising a pair of rearwardly opening slots in the panel lock member, each having a forward latching end engaging in front of a respective one of the latching protrusions.

6. Movement arresting means as recited in claim 1, wherein the panel lock is hollow and has an inner wall disposed opposite to, and in alignment with, a resilient latch which carries the latch bar, whereby pressure can be applied to said inner wall and said latch to urge them towards one another, thereby to release the latch bar from the latching projection.

7. Movement arresting means as recited in claim 6, wherein the panel lock is of overall rectangular shape, the latch being L-shaped having an arm projecting perpendicularly with respect to the inner wall of the panel lock and constituting the latch bar and having a forwardly chamfered free edge.

8. A panel lock member for use in means for arresting the movement of an electrical connector housing float mounted in a cut out in a mounting panel, in the direction of an edge of the cut out, the panel lock member comprising a pair of opposed side walls, connected by an upper wall and a lower wall, each of said walls having a front edge and a rear edge, each side wall having a rectilinear slot extending forwardly thereof and opening into the rear edge thereof, the top wall being formed with a latch comprising a first part parallel with but below the upper surface of the top wall and a second part constituting a latch bar and projecting upwardly from the forward end of said first part, the bottom wall being formed with a hollow, rectangular latch bolt having an upper wall parallel with the first part of the latch, the panel lock projecting forwardly of the second part of the latch.

9. A panel lock as recited in claim 8, wherein the latch bar terminates in a forwardly chamfered end face and projects at right angles with respect to the first part of the latch, the panel lock having a closed front end wall extending parallel to the latch bar.

10. An electrical connector housing for float mounting in a T-shaped cut out in a mounting panel, the housing comprising a forward mating face, a rear face, an upper face, opposite side walls connecting said forward and rear faces and at least one contact receiving through cavity opening into said mating face, the housing further comprising a pair of upper flanges and a pair or lower flanges, the flanges of each pair projecting beyond respective ones of said side walls, and a top flange projecting from said upper face above said upper flanges, each of said flanges having a panel engaging face, the panel engaging faces of the top flange and the lower flanges facing forwardly and the panel engaging faces of the upper flanges facing rearwardly and being positioned forwardly of the panel engaging faces of the top flange and the lower flanges, each flange having a rear face, the upper flange having formed therein a through socket opening into both the panel engaging face and the rear face of the upper flange, a one piece panel lock member being received in the socket, means on the panel lock member and in the socket, latching the panel lock member in a rearward position in the socket, the panel lock member having a panel lock projecting forwardly thereof, within the socket, said latching means providing for the panel lock member to be advanced under pressure to a forward position in the socket in which the panel lock projects beyond the panel engaging face of the top flange, and to be latched in said forward position, stop means being provided for limiting forward movement of the panel lock member.

11. A housing as recited in claim 10, wherein said latching means comprises a latching projection in the socket, the latching projection having a rearwardly chamfered surface and a forward latching shoulder; and a resiliently mounted latch bar on the panel lock member, the latch bar having a forwardly chamfered end surface for cooperation with the rearwardly chamfered surface of the latching projection so that upon said pressure being applied to the panel lock member, the latch bar can ride over the latching projection to lodge in front of the latching shoulder of the latching projection.

12. A housing as recited in claim 11, wherein said latching means further comprises oppositely positioned and forwardly extending blind slots in the panel lock member, said slots opening into a rear edge thereof and latching spurs in the socket engaged with forward ends of said slots to prevent rearward movement of the latching: member in the socket.

13. A housing s recited in claim 11, wherein said panel lock is hollow and said latch bar projects from a resilient wall portion of the panel lock member which portion is disposed opposite to said panel lock and is depressible towards said panel lock to release said latch bar from said shoulder.

14. A housing as recited in claim 10, wherein said top flange is formed with a second and similar socket receiving a second and similar panel lock member spaced laterally from, and aligned with, the first mentioned socket and panel lock member.

15. An electrical connector for mounting in a cut out in a panel, the panel having substantially parallel front and rear surfaces, the connector comprising:

a housing having at least one passage for at least one contact to be secured therein, said housing having a first flange face defining a first plane, said first flange face being for engaging one of the surfaces of the panel proximate to the cut out, and a second flange face defining a second plane, said second flange face being for engaging the other of the panel surfaces proximate to the cut out in the panel, said first and second planes being spaced apart by substantially the thickness of the panel between the surfaces thereof; and a panel lock latchingly secured within a socket in a flange of the housing in a first position by means of latching elements in the socket and on the panel lock, said panel lock being moveable in said socket transverse to said first plane to a second position in which at least a portion of the panel lock extends into the space between said first and second planes, whereby when the connector is mounted in the cut out in the panel, at least a portion of the panel is received in the space between said first and second planes, the panel lock in the first position is positioned out of the space between the first and second planes and when the panel lock is moved to the second position, at least a portion of the panel lock extends into the cut out i the space between the first and second planes, such that movement of the connector in the cut out is limited to prevent the connector being so positioned relative to the cut out to fall out of the panel.

16. A electrical connector as recited in claim 15, wherein the cut out is larger than the connector housing to provide a float mount.

17. An electrical connector as recited in claim 15, wherein the panel lock is latchable in the second position by cooperation between a latch bar on the panel lock and a latching projection in said socket.

18. An electrical connector as recited in claim 17, wherein in the second position of the panel lock the latch bar is releasable from the latching projection by depressing a wall of the panel lock which wall caries the latch bar, whereby the panel lock is free to be moved to the first position, thereby permitting the connector to be removed from the panel cut out.

* * * * *

UNITED STATES PATENT AND TRADEMARK OFFICE

CERTIFICATE OF CORRECTION

PATENT NO. : 5,184,964
DATED : February 9, 1993
INVENTOR(S) : Douty et al.

It is certified that error appears in the above-indentified patent and that said Letters Patent is hereby corrected as shown below:

Title page, item [57]:

In The Abstract

Line 5, "hosing" ahould be --housing--

Line 14, "pnael" should be --panel--

In The Claims

Claim 12, Column 12, line 2 delete ":" after "ing"

Claim 15, Column 12, line 42, "i" should be --in--

Claim 18, Column 12, line 57, "caries" should be --carries--

Signed and Sealed this

Nineteenth Day of July, 1994

Bruce Lehman

*Attest:*

BRUCE LEHMAN

*Attesting Officer*

*Commissioner of Patents and Trademarks*